US005200259A

United States Patent [19]

Bartholomew et al.

[11] Patent Number: 5,200,259

[45] Date of Patent: Apr. 6, 1993

[54] FIBER-FILLED CONCRETE OVERLAY IN CATHODIC PROTECTION

[75] Inventors: John J. Bartholomew, Mentor; Thomas J. Gilligan, III, Painesville, both of Ohio

[73] Assignee: ELTECH Systems Corporation, Boca Raton, Fla.

[21] Appl. No.: 748,618

[22] Filed: Aug. 22, 1991

Related U.S. Application Data

[63] Continuation of Ser. No. 456,697, Dec. 26, 1989, abandoned.

[51] Int. Cl.[5] ..... B32B 5/16

[52] U.S. Cl. ..... 428/224; 428/288; 428/392; 428/908.8; 204/80; 106/713

[58] Field of Search ..... 428/224, 288; 204/80; 106/713

*Primary Examiner*—Patrick J. Ryan
*Assistant Examiner*—Richard Weisberger
*Attorney, Agent, or Firm*—John J. Freer

[57] ABSTRACT

Reinforced concrete typically having steel reinforcing bars embedded in the concrete can have valve metal anodes forming a part of a cathodic protection system for the concrete structure. For embedding the anodes to serve in the cathodic protection system there is now used a fiber-filled concrete overlay. Polymeric or ceramic fiber is particularly useful in such overlay. There is now provided not only reduced shrinkage cracking for the overlay itself, but also lower current demand for the cathodic protection system.

21 Claims, No Drawings

FIBER-FILLED CONCRETE OVERLAY IN CATHODIC PROTECTION

This is a continuation of application Ser. No. 07/456,697 filed Dec. 26, 1989, now abandoned.

BACKGROUND OF THE INVENTION

Steel reinforced concrete structures, such as bridge decks and parking garages, have generally performed well. But a dramatic increase in the use of road salt, combined with an increase in coastal construction, has resulted in a wide spread deterioration problem caused by corrosion of the reinforcing steel within the concrete.

Valve metal electrodes as typified by expanded titanium mesh have recently gained wide acceptance for cathodic protection of reinforcing steel in concrete. Such electrodes, some of which have been detailed in PCT Published Application No. 86/06759 can readily cover broad surfaces. They may be rolled out on such a broad surface as a flat bridge deck or parking deck or bridge substructure. Such coverage has lead to the wide acceptance of this type of cathodic protection system. However, experience has shown that there is still need not only to efficiently install such cathodic protection systems, but also to efficiently and economically operate such systems once installed.

SUMMARY OF THE INVENTION

There has now been found a way for enhancing the efficient operation of a valve metal electrode cathodic protection system installed in concrete. The system can be enhanced without deleterious change in installation procedure. It is furthermore economical in not requiring the need to have on hand at the work site unusual materials. The enhancement readily lends itself to working on a variety of surfaces, e.g., an overhead surface, and around numerous obstructions on such surface. The enhancement can not only provide for more efficient operation of installed cathodic protection systems, e.g., lower resistivity, but also can augment the physical integrity of such systems, such as reduced shrinkage.

In a broad consideration, the invention is directed to a cathodically-protected steel-reinforced concrete structure having an impressed-current anode embedded in said concrete structure and spaced apart from steel reinforcing members also embedded in said concrete structure, and said anode comprises an electrocatalytically-coated valve metal anode, the improvement comprising a fiber-filled concrete overlay for said structure, which overlay contains non-smooth, non-conductive fiber resistant to degradation at elevated pH, and with said fiber-filled overlay embedding said valve metal anode.

In another aspect, the invention is directed to the method of cathodically protecting a metal reinforced concrete structure by utilizing the above-discussed innovation.

DESCRIPTION OF THE PREFERRED EMBODIMENTS

The cathodically-protected steel-reinforced concrete structure of the present invention can involve any of the usual concrete structures that are steel-reinforced and require cathodic protection with such protection utilizing an overlay. As representative of such structure will be a concrete bridge deck, but other such structures include parking garages, piers, and pedestrian walkways, as well as including the substructure or supporting structure, e.g., support columns and the like.

Where a surface of such a concrete structure is prepared for cathodic protection, there can then be placed on the surface of the prepared structure, the electrocatalytically coated valve metal anode. Suitable preparation techniques may include the application to the concrete structure of a polymeric separator, e.g., in mesh form, prior to application of the anode. Such polymeric separator application has been shown in copending application Ser. No. 376,720, the disclosure of which is incorporated by reference.

The metals of the valve metal anode substrate which will be useful for the cathodic protection of the steel reinforcement will most always be any of titanium, tantalum, zirconium and niobium. As well as the elemental metals themselves, the suitable metals of the anode can include alloys of these metals with themselves and other metals as well as their intermetallic mixtures. Of particular interest for its ruggedness, corrosion resistance and availability is titanium and representative of such serviceable metal is Grade I titanium.

The valve metal anode substrate may be in different forms, e.g., a ribbon form such as discussed in copending application Ser. No. 178,422, the teachings of which are incorporated herein by reference. Or the anode substrate may be in wire form, as disclosed for example in U.K. Patent Application 2,175,609. Although it is to be understood that these and other shapes may be particularly serviceable, the anode substrate will generally be a valve metal mesh, e.g., scallop-shaped or hexagonal shape, but most typically diamond-shaped. Such valve metal mesh anode substrates have been more particularly described in copending application Ser. No. 855,550 the teachings of which are herein incorporated by reference.

Where the anode substrate is a valve metal mesh, such will usually have individual strands of a thickness that does not exceed about 0.125 centimeter and a width across the strand which may be up to about 0.2 centimeter. The more typical "diamond-pattern" will feature apertures having a long way of design (LWD) from about 4, and preferably from about 6, centimeters up to about 9 centimeters, although a longer LWD is contemplated, and a short way of design (SWD) of from about 2, and preferably from about 2.5, up to about 4 centimeters. The mesh can be produced by expanding a sheet or coil of metal of appropriate thickness by an expansion factor of at least 10 times, and preferably at least 15 times. Useful mesh can also be prepared where a metal sheet has been expanded by a factor up to 30 times its original area. Further in this regard, the resulting expanded mesh should have an at least 80 percent void fraction for efficiency and economy of cathodic protection. Most preferably, the expanded metal mesh will have a void fraction of at least about 90 percent, and may be as great as 92 to 96 percent or more, while still supplying sufficient metal and economical current distribution. Within this expansion factor range, suitable redundancy for the metal strands will be provided in a network of strands most always interconnected by from about 500 to about 2,000 nodes per square meter of the mesh. Greater than about 2,000 nodes per square meter of the mesh is uneconomical. On the other hand, less than about 500 of the interconnecting nodes per square meter of the mesh may provide for insufficient redundancy in the mesh.

The valve metal anode substrate has an electrocatalytic coating. Usually before coating, the valve metal substrate will be subjected to a cleaning operation, e.g., a degreasing operation, which can include cleaning plus etching, as is well known in the art of preparing a valve metal to receive an electrochemically active coating. It is also well known that a valve metal, which may also be referred to herein as a "film-forming" metal, will not function as an anode without an electrochemically active coating which prevents passivation of the valve metal surface. This electrochemically active coating may be provided from platinum or other platinum group metal, or it may be any of a number of active oxide coatings such as the platinum group metal oxides, magnetite, ferrite, cobalt spinel, or mixed metal oxide coatings, which have been developed for use as anode coatings in the industrial electrochemical industry. It is particularly preferred for extended life protection of concrete structures that the anode coating be a mixed metal oxide, which can be a solid solution of a film-forming metal oxide and platinum group metal or platinum group metal oxide.

The mixed metal oxide coating is highly catalytic for the oxygen evolution reaction, and in a chloride contaminated concrete environment, will evolve no chlorine or hypochlorite. The platinum group metal or mixed metal oxides for the coating are such as have been generally described in one or more of U.S. Pat. Nos. 3,265,526, 3,632,498, 3,711,385 and 4,528,084. More particularly, such platinum group metals include platinum, palladium, rhodium, iridium and ruthenium or alloys of themselves and with other metals. Mixed metal oxides include at least one of the oxides of these platinum group metals in combination with at least one oxide of a valve metal or another non-precious metal. It is preferred for economy that the coating be such as have been disclosed in the U.S. Pat. No. 4,528,084.

Application of the coated valve metal anode for corrosion protection such as to a concrete deck or substructure can be simplistic. A roll of mesh or coil of ribbon is simply unrolled and in so doing is applied against the concrete. Thereafter, means of fixing the anode to substructure can be any of those useful for binding a metal to concrete that will not deleteriously disrupt the anodic nature of the anode. Usually, non-conductive retaining members will be useful. Such retaining members for economy are advantageously plastic and in a form such as pegs or studs. For example, plastics such as polyvinyl halides or polyolefins can be useful. These plastic retaining members can be inserted into holes drilled into the concrete surface. Such retainers may have an enlarged head engaging a strand of mesh or wire or ribbon under the head to hold the anode in place, or the retainers may be partially slotted to grip a strand of the anode located directly over the hole drilled into the concrete. Current distributor members, e.g., metal strips, are applied to the valve metal anode and fixed to the anode as by welding.

In such concrete corrosion retarding application, the metal anode will be connected to current supply means including a current distribution member, usually an elongate member such as a metal strip laid down on top of the valve metal anode. Such member will most always be a valve metal and preferably is the same metal or alloy or intermetallic mixture as the metal most predominantly found in the valve metal anode. The current distribution member must be firmly affixed to the metal anode, as by welding. The member in strip form can be welded to a mesh anode at every node and thereby provide uniform distribution of current thereto. Such current distributor member can then connect outside of the concrete environment to a current conductor for supplying an impressed current, e.g., at a current density of up to 200 $mA/m^2$ of the valve metal anode surface area.

Usually when the anode is in place and while held in close contact with the concrete substructure by means of the retainers, an ionically conductive fiber-filled overlay will be employed to embed the resulting mesh structure. Such overlay will further enhance firmly fixing the anode in place over the concrete substructure. Useful overlays can be formulated from portland cement and polymer-modified concrete, i.e., latex-modified concrete. Before application of the overlay, it may be serviceable to apply a cement-based bonding grout to the resulting mesh structure.

Where the anode is resting on the concrete substructure for example where a ribbon valve metal anode is placed flat onto the concrete substructure, the overlay will serve to cover the exposed upper ribbon surface. The anode will then have a face contact the substructure and the remainder covered by the overlay. Where the anode is resting on a polymeric separator or where the anode may be typically in strand form and the strands are gripped by the heads of retainers, the anode can be separated from or slightly above the concrete substructure. In these instances, application of the overlay can completely surround the anode, and will at least substantially cover any polymeric separator. Whether the overlay covers the anode, e.g., the flat ribbon anode as above described, or completely surrounds the anode such as separated from the concrete substructure for purposes of convenience, all such applications will typically be referred to herein as having the anode "embedded" in the overlay.

Where the overlay is Portland cement or a mix including Portland cement, it is contemplated that there will be used any Portland cement which is typically serviceable for overlay purposes. Such overlay may additionally include a fine aggregate such as sand as well as coarse aggregate, e.g., crushed rock or gravel, typically having a particle size of 0.25 to 1 inch. Such concrete overlay may be referenced to herein for convenience simply as a "grout". When latex modified concrete is used, it is suitable to utilize any such latex as may be useful in concrete such as an acrylate, epoxy or styrene-butadiene rubber latex. The overlay will most typically be applied to provide a thickness of from about ½ inch to on the order of 2 inches thickness or more. Usually, the thinner amounts of overlay of on the order or a ½ inch, e.g., ½ to 1 inch, will be applied to columns, pilings, parking garage floors and the like. Thicker overlays of greater than an inch to 2 inches or more will usually be applied to bridge decks, pier substructures and tunnel substructures.

For purposes of the present invention, the concrete overlay will contain an electrically non-conductive fiber that retains integrity at elevated pH, e.g., on the order of pH 12. Glass fibers are representative of fibers that are unsuitable since they are not resistant to degradation in concrete as such elevated pH. Suitable useful fibers include ceramic fibers, such as fibers of alumina, titania and zirconia, as well as polymeric fibers. The useful polymers can be one or more of a great variety of polymeric fibers, both thermoplastic and non-thermoplastic. Representative of serviceable polymers for the fibers include polyolefins such as polyethylene and polypropylene fibers, polyaramides such as Kevlar TM aromatic polyamide fibers, polyamides such as nylon, polyhalocarbon fibers including polytetrafluoroethylene fibers, polycarbonate and polyester fibers such as polyethylene terephthalate fiber and the like.

The fibers can be suitably used in the concrete overlay as individual fibers or the fibers may be utilized as bundles, e.g., fibrillated polymer fiber bundles. Mixing such fibrous bundles into the concrete will serve to suitably expand the bundles into a desirable fibrous consistency. As will be understood by those skilled-in-the-art of utilizing fibers with concrete, the fibers that are useful herein are not smooth. For example, such fibers are not smooth monofilaments, but should have a rough surface, e.g., fibrillated in the nature of baling wire twine, or should be bundled or have the ability to expand to a fibrillated bundle. Preferably for economy in use combined with desirable roughness, there are used fibrillated polypropylene fiber bundles.

The fibers will generally have average fiber length at least equal to the thickness of an overlay coating layer, and it is most useful that the fibers have an average fiber length greater than the depth or thickness of the overlay to be applied. Thus where an about ½ inch overlay is to be applied to a column, it is most advantageous that the fibers contained in such overlay have average length of greater than ½ inch, e.g., ¾ inch to 1 inch, or more. Where thicker overlays are applied, e.g., up to 2 inches or more on a bridge deck, it is acceptable that the fiber length average ¾ inch, for example, and that several coats of the concrete overlay, such as several ½ inch thick coats, be used to provide the desired concrete overlay thickness. Most usually, the fibers will have an average length of from about ½ inch to about 1 inch or more, e.g., 1.5 inches, and can have strand thickness of from as thin as 50 microns or less, up to a thickness for bundles of as much as 3 millimeters or more.

Where polymer fibers are utilized, the fiber will most always be present in the concrete overlay in an amount of from about 1 pound to about 20 pounds of fibers per cubic yard of concrete overlay. Use of less than about 1 pound of fiber may not provide sufficient fiber for yielding desirable benefit. On the other hand, greater than about 20 pounds of fiber per cubic yard of concrete, can be uneconomical. Regardless of the type of fiber, advantageously the fiber will be present in an amount from about 2 to about 10 pounds per cubic yard of concrete and preferably for best economy and efficiency, the fiber is present in the concrete in an amount from about 5 to about 8 pounds of fiber per cubic yard of concrete overlay.

As evidence of such concentration at least with regard to polymer fiber for utilization in a cathodic protection system and as it can desirably affect lowered volumetric resistivities, such may be demonstrated with grouts prepared from a mixture of Portland cement and silica sand in a per cubic yard basis of 1:3. The resistivity effect can be demonstrated with this grout using initially a "control" containing no polymer fiber. Additional portions contain 1.6 pounds of polymer fiber ("normal" or 1×, i.e., the conventional amount that would be utilized for this particular polymer fiber in concrete), 3.2 pounds (2×) or 6.4 pounds (4×), per cubic yard of concrete, of ¾ inch long, Forta CR fibrillated polypropylene fiber. Volumetric resistivities for cured test samples as measured by the 4-pin technique are as follows:

TABLE

| Concentration of Polymer Fiber Per Cubic Yard of Grout | Volumetric Resistivity: Ohm-Cm. |
|---|---|
| Control (no polymer) | 18,827 |
| 1× | 18,702 |
| 2× | 13,715 |
| 4× | 14,962 |

It is suitable to add the fiber to the concrete at any stage of the mixing operation. For example, the fiber may be admixed with the cement, fine aggregate, or fine aggregate and coarse aggregate, added to prepare the concrete. Or the fiber can be admixed to the concrete overlay after all other ingredients have been blended together. It is to be understood that one or more of additional ingredients typically used with concrete will be serviceable for use in the concrete overlay. For example, agents such as latex modifiers, air entraining agents, superplasticizers, or water reducing agents may also be present in the concrete overlay.

As mentioned hereinabove, the concrete overlay can be applied as a single coat or as several layers. Any application technique useful for applying a concrete overlay to a substructure is contemplated as being useful in the present invention. The overlay may be mixed and placed by either the dry or wet shotcrete process. More typically for application to vertical surfaces such as columns and pilings, the overlay can be spray applied. The resulting finished structure can have excellent mechanical properties and reduced shrinkage cracking of the overlay providing for a longer lasting overall system.

The following example shows a way in which the invention has been practiced, but should not be construed as limiting the invention.

EXAMPLE

For test purposes, concrete slabs were prepared from Type I Portland cement, silica sand fine aggregate and 1 inch minus coarse aggregate in a weight proportion of cement to sand to coarse aggregate, on a per cubic yard basis, of 1:2:2.95. Each slab measured one square foot by six inches thick and contained eight steel reinforcing bars in double-mat construction. The concrete was cured by spraying the surface at a rate of 200 square feet/gallon with a water-based curing compound (Masterkure TM) followed by maintaining the concrete under plastic for fourteen days, lab air for seven days and then to outdoor exposure.

Slab top surfaces were sandblasted and fitted with an electrocatalytically coated, titanium mesh anode. The electrocatalytic coating was a mixed metal oxide containing oxides of iridium, titanium and platinum. The anode mesh electrodes were more particularly anodes of ninety-four percent void volume while having 0.09 centimeter strand thickness, with the anode mesh being spaced two inches from the steel reinforcing bars. The anodes were covered with an overlay. The overlay of polymer-fiber modified concrete was 2 inches thick. The overlay was prepared from a mixture of Portland cement, silica sand and coarse aggregate in a per cubic yard basis, of 1:2.56:2.03. The overlay contained 3.2 pounds per cubic yard of concrete, of ¾ inch long, fibrillated polypropylene fiber. The overlay was cured one day with wet burlap and plastic followed by six days lab air. For cathodic protection system activation, there was used an anodic current density of 10 and 40 milliamps per square foot (mA/ft$^2$). Overlaid test slabs were subjected to outdoor exposure on above-ground racks under conditions obtained during the months of July to November in Northeastern Ohio.

Slabs were inspected after 83 days and none of the slabs contained discernable cracking.

What is claimed is:

1. In a cathodically-protected steel-reinforced concrete structure having an impressed-current anode embedded in said concrete structure and spaced apart from steel reinforcing members also embedded in said concrete structure, and said anode comprises an electrocatalytically-coated valve metal anode, the improvement comprising a fiber-filled concrete overlay for said structure, which overlay contains from above about 3.2 pounds to about 20 pounds, per cubic yard of said overlay, of non-smooth, non-conductive, fibrillated polymeric fiber comprising polymeric fiber bundles, said fibrillated and bundled polymeric fiber having average fiber length at least as long as the thickness of a coating layer of said overlay, said fiber being resistant to degradation at elevated pH, and with said fiber-filled overlay embedding said valve metal anode.

2. The structure of claim 1, wherein said overlay has a coating layer thickness of about 0.5 inch.

3. The structure of claim 1, wherein said fiber has average fiber length of at least about 0.75 inch.

4. The structure of claim 1, wherein said fiber-filled overlay embeds said anode in several coats of overlay.

5. The structure of claim 1, wherein said polymeric fiber is one or more of polyolefin, polyaramide, polyamide, polyhalocarbon, polycarbonate or polyester fibers.

6. The structure of claim 1, wherein said fiber-filled overlay is present on said structure at a thickness of from about 0.5 inch to about 2 inches thickness of said overlay.

7. The structure of claim 1, wherein said fiber-filled overlay comprises Portland cement or latex modified concrete.

8. The structure of claim 1, wherein said fiber-filled overlay further contains one or more of latex modifier, air entraining agent, superplasticizer or water reducing agent.

9. The structure of claim 1, wherein the valve metal of said valve metal anode is selected from the group consisting of titanium, tantalum, zirconium, niobium, their alloys and intermetallic mixtures.

10. The structure of claim 1, wherein said anode comprises a thin and elongate valve metal ribbon with the surface of the valve metal ribbon carrying said electrocatalytic coating.

11. The structure of claim 1, wherein said anode comprises at least one sheet of valve metal mesh having a pattern of voids defined by a network of valve metal strands, with the surface of the valve metal mesh carrying said electrocatalytic coating.

12. The structure of claim 11, wherein the valve metal mesh consists of a sheet of expanded valve metal expanded by a factor of from 15 to 30 times to provide a pattern of substantially diamond shaped voids and a continuous network of valve metal strands interconnected by between about 500 to 2,000 nodes per square meter of the mesh, while having an at least about 90 percent void fraction.

13. The structure of claim 11, wherein the valve metal mesh strands have thickness within the range of from about 0.05 centimeter to about 0.125 centimeter and width within the range of from about 0.05 centimeter to about 0.20.

14. The structure of claim 1, wherein the valve metal anode further comprises at least one current distribution member for supplying current to the valve metal anode.

15. The structure of claim 14, further comprising a current supply connected to the current distribution member to supply a cathodic protection current at a current density up to 200 mA/m$^2$ of the anode surface area.

16. The structure of claim 1, wherein the electrocatalytic coating contains a platinum group metal or metal oxide.

17. The structure of claim 1, wherein the electrocatalytic coating contains at least one oxide selected from the group consisting of the platinum group metal oxides, magnetite, ferrite, and cobalt oxide spinel.

18. The structure of claim 1, wherein the electrocatalytic coating contains a mixed crystal material of at least one oxide of a valve metal and at least one oxide of a platinum group metal.

19. The structure of claim 1, wherein current is distributed to the valve metal anode by a valve metal current distribution member metallurgically bonded to said anode.

20. In a cathodically-protected steel-reinforced concrete structure having an impressed-current anode embedded in said concrete structure and spaced apart from steel reinforcing members also embedded in said concrete structure, and said anode comprises an electrocatalytically-coated valve metal anode, the improvement comprising:

(a) a polymeric separator interposed between said valve metal anode and said steel-reinforcing members; and (b) a polymer fiber-filled concrete overlay embedding said anode and said polymeric separator, wherein the said overlay contains from above-about 3.2 pounds to about 20 pounds, per cubic yard of said overlay, of non-smooth, non-conductive, fibrillated polymeric fiber comprising polymeric fiber bundles, said fibrillated and bundled polymeric fiber having average fiber length at least as long as the thickness of a coating layer of said overlay, said fiber being resistant to degradation at elevated pH, and with said fiber-filled overlay embedding said valve metal anode.

21. The structure of claim 1, wherein said fiber-filled overlay contains from above about 3.2 pounds to about 20 pounds, per cubic yard of said overlay, of said polymeric fiber and further contains ceramic fiber.

* * * * *